United States Patent [19]

Mains

[11] 4,377,388

[45] Mar. 22, 1983

[54] DEEP IMMERSION SHRINKPROOFING OF WOOL

[75] Inventor: Frank Mains, Don Mills, Canada

[73] Assignee: Kroy Unshrinkable Wools, Limited, Toronto, Canada

[21] Appl. No.: 113,333

[22] Filed: Jan. 18, 1980

Related U.S. Application Data

[60] Continuation of Ser. No. 905,853, May 15, 1978, abandoned, which is a division of Ser. No. 685,251, May 11, 1976, abandoned.

[30] Foreign Application Priority Data

May 15, 1975 [GB] United Kingdom ..... 20652/75

[51] Int. Cl.[3] ..... D06M 3/08; D06M 13/52

[52] U.S. Cl. ..... 8/128 R; 8/151; 8/156; 68/158; 68/44

[58] Field of Search ..... 8/128 R, 151

[56] References Cited

U.S. PATENT DOCUMENTS

| | | | |
|---|---|---|---|
| 2,499,987 | 3/1950 | Clapham et al. | 8/128 |
| 2,540,140 | 2/1951 | Reichert | 8/128 |
| 2,552,078 | 5/1951 | Williams | 68/44 |
| 2,671,006 | 3/1954 | McLauchlan | 8/128 |
| 2,779,183 | 1/1957 | Fornelli | 68/181 R |
| 3,076,690 | 2/1963 | Hayashi | 8/128 |
| 3,203,207 | 8/1965 | Poncelet | 68/44 |
| 3,628,909 | 12/1971 | Goldberg et al. | 8/128 R |
| 3,811,835 | 5/1974 | Gallup et al. | 8/128 A |

FOREIGN PATENT DOCUMENTS

| | | | |
|---|---|---|---|
| 511713 | 4/1955 | Canada | 8/128 R |
| 1460174 | 12/1968 | Fed. Rep. of Germany . | |
| 2121722 | 11/1972 | Fed. Rep. of Germany . | |
| 500646 | 5/1937 | United Kingdom . | |
| 655415 | 7/1951 | United Kingdom . | |
| 1067736 | 5/1967 | United Kingdom . | |
| 1281178 | 7/1972 | United Kingdom . | |
| 1295729 | 11/1972 | United Kingdom . | |
| 1332685 | 10/1973 | United Kingdom . | |

OTHER PUBLICATIONS

Zimmerman, H., Amer. Dye stuff Rep., 8/25/47, pp. 473–475.

Moeller, T., Inorganic Chem., John Wiley & Sons, N.Y., p. 439.

Williams, S. H., "Continuous Fiber Dyeing", *American Dyestuff Reporter,* pp. 360–364, Jun. 9, 1952.

*Primary Examiner*—Maria Parrish Tungol

*Attorney, Agent, or Firm*—Schwartz, Jeffery, Schwaab, Mack, Blumenthal & Koch

[57] ABSTRACT

According to the invention disclosed herein wool sliver may be effectively shrinkproofed by immersing the sliver continuously into a bath of shrinkproofing solution to a depth of at least 1 meter if said sliver is carried down into said solution within 10° of vertical. According to the invention the most useful solution is an aqueous solution into which chlorine gas has been aspirated. An apparatus according to the invention comprises a substantially U-shaped bath having a depth exceeding 1 meter and equipped with means to convey wool sliver into said bath within 10° of vertical.

7 Claims, 1 Drawing Figure

DEEP IMMERSION SHRINKPROOFING OF WOOL

Figure 1:
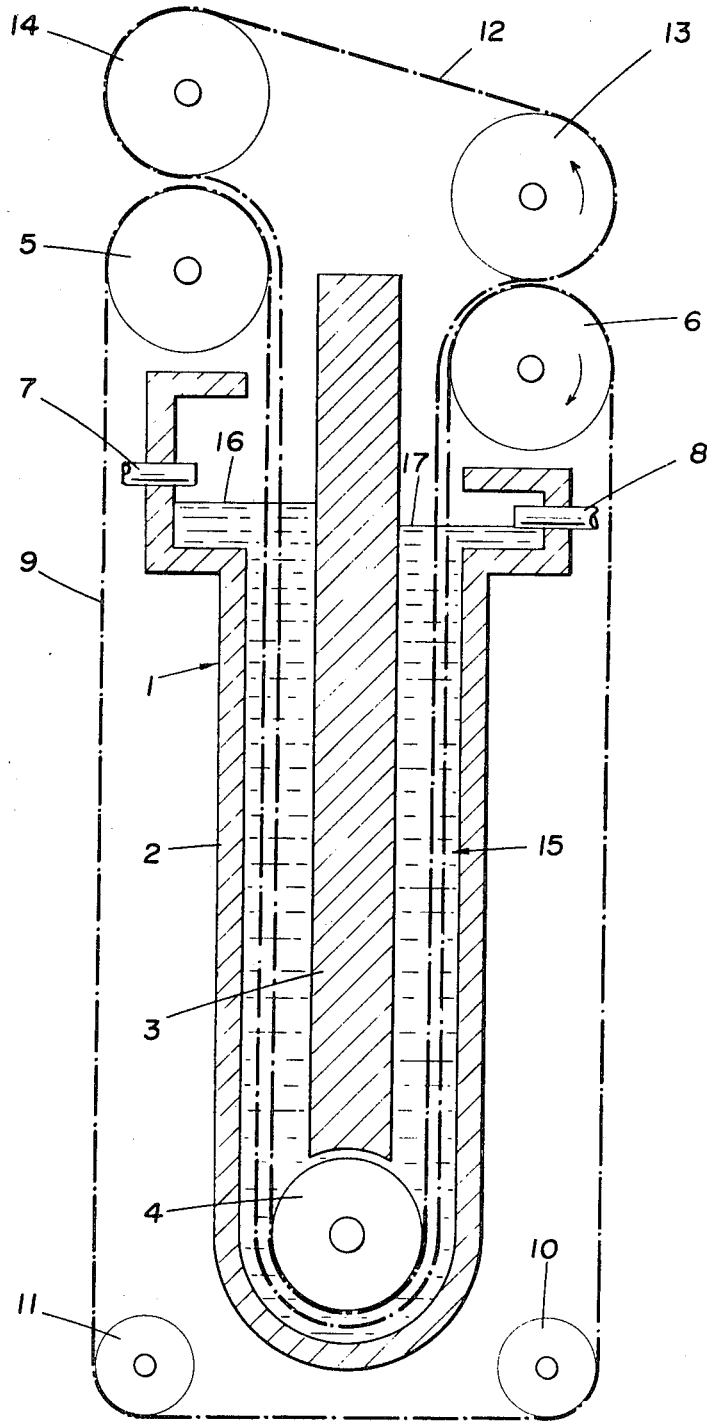

This is a continuation, of application Ser. No. 905,853, filed May 15, 1978 now abandoned which is a divisional of Ser. No. 685,251 filed May 11, 1976, now abandoned.

This invention relates to the shrinkproofing of wool sliver. Disclosed herein is a novel process and an apparatus particularly suitable for carrying out the novel process. Also disclosed herein is a particular solution which is advantageous in the shrinkproofing of wool not only with the novel apparatus and process disclosed herein but generally in the field of shrinkproofing of wool.

Wool sliver is a commercial product which is produced in a variety of relatively uniform sizes. Sliver is normally described in terms of its quality and in terms of the weight of a 5 yard length of material. Thus, a 2 ½ ounce sliver indicates that this particular sliver would weigh 2 ½ ounces for a 5 yard length. This sliver would be approximately 1 inch in diameter.

In the normal processing of wool, wool fibres are obtained by clipping from an animal. The clipped fibres are then baled. After collection in bales the raw wool may be scoured and carded. In this state the wool is referred to as card sliver. Card sliver upon combing to remove adventitious materials receives a slight twist and is referred to as top sliver. Top sliver may be drawn such that its diameter is reduced at which time it is then referred to as roving. Roving may be twisted into yarn. Several plies of yarn may be then twisted to form a thread. Generally speaking, wool will be treated while in either the card sliver or top sliver state. However, the invention disclosed hereinafter is useful in any of the stages from card sliver through to thread. Accordingly, the word "sliver" as used hereinafter is intended to be broad enough to encompass card sliver, top sliver, roving, yarn and thread.

It is well known in the prior art that wool sliver may be shrinkproofed by immersing it in an aqueous hypochlorite solution. There has been much technical study and many patents in this field.

It is generally acknowledged that the major reactant involved is hypochlorous acid which is one of the entities in wet chlorine systems, and that the reaction should, as far as possible, be confined only to the surface of the fibres. The reaction between wool and hypochlorous acid tends to be exceedingly rapid and difficult to control so that the major difficulty is one of obtaining "even treatment" of the fibres.

Since the chemical equilibrium involved in HOCl solutions is very pH dependent and since the by-product of the HOCl/wool reaction is the completely dissociated HCl, a self accelerating action is set up at the original reaction site.

Since the rate of the wool/hypochlorous reaction is so fast, it is possible for some of the fibres to be "wetted" by reactant solution which has lost its HOCl content in a first reaction. It is obvious, then, that if the reactant solution is to maintain homogeneity, the rate of its dispersion through the fibres must be faster than the wool/hypochlorous reaction rate if the desired end of even treatment is to be met. To achieve this, several methods have been used to reduce the reaction rate including temperature control; pH modification and addition of sacrificial amino compounds. Any or all of these methods have been coupled with agitation, vibration or wetting agent additions to speed the rate of liquid dispersion. Despite all of this work, the attainment of even treatment is still a major difficulty.

It is in the nature of this invention, that even and homogenous treatment of combed wool sliver can be obtained by use of a mechanical procedure designed to take specific advantage of the geometry of combed wool sliver.

The invention is based in the discovery that the rate of air displacement by the solution for sliver continuously immersed within 10° of the vertical is smooth and even, whereas for sliver immersed horizontally the rate is slow and discontinuous. Because the sliver consists of combed wool fibres air trapped in the capillaries will be smoothly and uniformly displaced only if the sliver is introduced in the bath in a substantially vertical direction. Immersion of the sliver in the bath in a horizontal direction or nearly horizontal direction will result in entrapment of the air in the capillaries of the sliver and thereby results in uneven shrinkproofing of the wool.

Heretofore, wool sliver has been immersed in an appropriate bath at any convenient angle which normally will approach the horizontal. The sliver then travels in a more or less horizontal plane through the bath for an appropriate amount of time to permit treatment by the solution. In order to assist in the treating of the sliver with this type of bath and immersion arrangement the bath is often agitated.

According to this invention the wool sliver is introduced into the bath in a substantially vertical direction and travels downward through the solution in a substantially vertical direction to an appropriate depth. By a suitable choice of the depth to which the sliver is immersed and the rate at which it is carried into the bath, it is possible to obtain even and homogenous filling of the capillary spaces between the combed fibres with reactant liquid in a time less than that required for the wool/hypochlorite reaction. The combed wool sliver (whose capillaries are filled with air) is conveyed substantially vertically into the reactive chlorine solution to a depth of not less than 1 meter at a rate of about 7 centimeters to about 25 centimeters per second. The sliver must be submerged substantially vertically to a depth of at least 1 meter in order that all air may be removed from the capillaries in order that even treatment of the sliver will be achieved. Because the sliver is a relatively delicate product which cannot be subjected to tensile stresses of any significance the sliver may most advantageously be carried into the bath between or on endless screens.

While the sliver is being submerged the air is smoothly displaced from the capillaries by the chlorine liquor. The screens carry the combined wool sliver and capillary liquor around a roll or guide at the bottom of the tank and up through the solution and out of the bath exit.

The sliver now evely wetted with reactant liquor, is allowed to complete its reaction and is then squeezed, rinsed free from spent liquor and dried.

Sliver so treated is very evenly shrinkproofed and the secondary procedures of attempting to control the rate of reaction by adjustment of pH, of temperature or by adding amino compounds; or of improving the wetting rate by the use of surfactants or agitators or vibrators seem to be unnecessary. The degree of shrinkproofing is easily controlled by adjusting the concentration of hypochlorous acid in the solution.

In essence, an apparatus designed according to this invention consists of a bath of sufficient depth to permit immersion of sliver to a depth of at least 1 meter of fluid. The apparatus will consist of a pulley or guide at the top over which the sliver and its conveying means may be made to pass. A similar pulley or guide will be located at the bottom of the tank. And thirdly, a similar pulley or guide will be located at the exit to withdraw the sliver and conveying means for the tank.

Normally, the final guiding member will be located above the bath in such a way as to withdraw the wool sliver from the bath as quickly as possible. As the feed rate of sliver is governed by the immersion rate into the bath, obviously withdrawal from the bath in minimum time may only be achieved by removing the sliver according to the shortest path, i.e. vertical. This is desirable although not necessary in order to prevent secondary oxidation by diffusion of more hypochlorous acid. If the sliver is overtreated wool of an unsatisfactory quality and colour will result. However, if suitable sealing means could be provided it would be permissible within the terms of this invention to remove the wool sliver from the solution in any particular direction.

Over treatment of the wool may be easily prevented by use of a U-shaped bath. If a suitable hypochlorous solution is introduced into such a bath at a point relatively near to the point where the wool sliver is introduced the liquor is fresh. By ensuring a flow of liquor along the U-shaped bath in the same direction of flow as followed by the wool the liquor relatively near the point where the wool is withdrawn from the bath will be weak or spent. Thus, the liquor is caused to flow down one side of the U-shaped bath in which the sliver is travelling downwardly and up in the other leg of the bath. Supply means are incorporated in upper portions of the first mentioned leg of the bath and drain means are provided at the upper end of the second mentioned leg. As the wool sliver is removed from the bath it will of course remove with it some entrapped liquid.

The solution to be used in such a bath is a hypochlorite solution. The best solution known to the inventors is made by passing chlorine gas into water. Such a solution contains less chloride ion than solutions commercially used to-day, and accordingly has a higher concentration of hypochlorous acid per unit of available chlorine.

Aqueous solutions of hypochlorite are characterized by the uneasy equilibrium between the components. The equilibrium is very pH dependent and can be characterized thus:

$$OCl + H^+ \rightleftharpoons HOCl + H^+ + Cl^- \rightleftharpoons H_2O + Cl_2$$

$$14 \longleftarrow \text{pH} \longrightarrow 1$$

Consequently, the effective concentration of the HOCl entity is dependent on both the total available chlorine of the solution and its pH value.

Shrinkproofing procedures usually operate with solution of about 0.05% hypochlorous acid obtained by different combination of pH and total chlorine (Harris, U.S. Pat. No. 2,466,695; Edwards, British Pat. No. 537,671; Kroy, U.S. Pat. No. 2,671,006). In summary, the overall reaction could be designated as:

$$\text{Wool} + HOCl \rightarrow \text{oxidized wool} + H^+ + Cl^-$$

The by-product of this reaction (the hydrogen and chloride ions) when released have a very important effect upon the hypochlorite/hypochlorous equilibrium.

In the upper pH conditions (pH 5 to pH 14) the released hydrogen ion converts the unreacted hypochlorite ion to the relatively undissociated hypochlorous acid:

$$O\bar{C}l + H^+ \rightarrow HOCl$$

This secondary hypochlorous acid can produce localized secondary oxidation which may continue so long as hypochlorite ion is available.

Consequently, alkaline hypochlorination (so-called) tends to produce more secondary oxidation (damage) per degree of primary oxidation (shrinkproofing) and this shows as increased damage to the wool fibres.

To offset this, according to prior art procedures, recourse is had to a very rapid treatment with the hypochlorite solution followed by immersion in a stop bath to destroy the residual hypochlorite. The relatively slow rates of liquid diffusion through wool fibres and the exceedingly fast rate of the wool hypochlorite reactions and hypochlorite/hypochlorous equilibria make the procedure exceedingly difficult.

In acid conditions (pH 5 or less) the release of by-product HCl decreases the HOCl concentration:

$$HOCl + H^+ + Cl^- \rightleftharpoons H_2O + Cl_2$$

and it is interesting to note that since the by-product releases of $H^+$ and $Cl^-$ are stoichiometric the rate of the reaction is proportional to the square of the hydrogen ion release concentration.

$$K_1 [HOCl] [H^+] [Cl^-] = K_2 [Cl_2]$$

$$\therefore [HOCl] = \frac{K_2}{K_1} \frac{[Cl_2]}{[H^+] [Cl^-]}$$

$$\text{since } [\overset{+}{H}] = [Cl^-] \text{ and } \frac{K_2}{K_1} = K$$

$$[HOCl] = \frac{K [Cl_2]}{[H^+]^2}$$

Hence release of by-product $H^+$ and $Cl^-$ from the initial shrinkproofing reaction produces a very dramatic fall in pH equilibrium HOCl content of the shrinkproofing solution.

Consequently, in acid solutions the oxidation by hypochlorous acid is self-limiting at the primary stage and the result is shown in the much lesser degree of damage per effective degree of shrinkproofing.

Commercial hypochlorite solutions have available chlorine values of 1% to 16%. They are invariable alkaline (generally pH 12). They are formed by passing gaseous or liquid chlorine into cooled alkaline solutions. The reaction can be represented thus:

$$Cl_2 + 2NaOH \rightarrow NaCl = NaOCl + H_2O + \text{heat}$$

The reaction is generally stopped a little short of the stoichimetric point so as to keep the solution at pH 12.

To make hypochlorous acid solution such commercial hypochlorite solutions are progressively diluted and neutralized with mineral acid, generally muriatic acid.

There are several objections to this procedure:

1. Alkaline hypochlorite solutions undergo steady degradation with time and with temperature thus:

$$NaClO \rightarrow Na^+ + Cl^- + (O)\uparrow$$

Consequently as they age the concentration of chloride ion as a function of available chlorine steadily increases.

2. Acidification means not only the conversion of NaCl0 to HCl0 but also the neutralization of the excess alkali in the solution. Consequently this, too, produces an increased concentration of chloride ion as a function of the total available chlorine.

3. The heat of neutralization effectively increases the temperature of the hypochlorous acid solutions and since hypochlorous acid is quite volatile, cooling is required to produce satisfactory shrinkproofing solutions. In such acidified solutions the equilibrium is expressed as:

$$HOCl = \frac{K_1 \times [Cl_2]}{[H^+] \times [Cl^-]}$$

It is obvious that increases in the chloride ion concentration of the solution produce a corresponding reduction in the true [HOCl] per unit of total available chlorine.

Contrary to commercial practice to-day, the pH and available chlorine values are not sufficient to determine the true concentration of HOCl. To determine true [HOCl] consideration must be given to the chloride ion concentration.

Consequently, acidified solutions of commercial alkaline hypochlorite solutions are lower than expected in true concentration of hypochlorous acid.

However, fresh hypochlorous acid solution can be readily obtained by passing chlorine gas into water:

$$Cl_2 + H_2O \rightarrow H^+ + Cl^- + HCLO$$

Such a solution proves to be more advantageous for shrinkproofing because it contains less chloride ion (than the previously described acidified commercial product) and therefore has a higher concentration of hypochlorous acid per unit of available chlorine.

It will be appreciated from the previous description that a solution prepared according to the foregoing method will be essentially self limiting in the wool shrinkproofing reaction. Accordingly, it may be used in any form of bath wherein the solution is evenly distributed throughout the wool sliver. Since the reaction is self limiting, it is not necessary to subject the wool sliver to after bath treatment to stop the chemical reaction in order to obtain acceptable quality shrinkproof wool.

In accordance with this invention, effective shrinkproofing solutions may be obtained by aspirating chlorine into the feed water system of the shrinkproofing process. Solutions of available chlorine (0.05 to 0.25) at pH values at 2.0 to 2.6 and temperatures of 6° C. to 20° C. are easily obtained. As a consequence, neither artificial cooling nor cumbersome neutralization procedures are required according to the invention disclosed herein. It will be particularly obvious that the solution disclosed herein may be used advantageously in conjunction with the method and apparatus disclosed herein to provide a single bath treatment of wool wherein the wool is uniformly treated with little or no danger of secondary treatment and damage to the wool.

FIG. 1 is a schematic vertical cross-section taken through an apparatus embodying the invention.

The apparatus designated generally as 1 comprises an outer shell 2 defining a liquid holding tank. A baffle or partition 3 divides the tank into a U-shaped liquid container. Located towards the bottom of the tank and beneath the partition is a submerged roll 4. Located above the tank are cooperating rolls 5 and 6. Rolls 5 and 6 are located with respect to roll 4 such that a line tangent to each of roll 4 and roll 5 and the line tangent to each of roll 4 and roll 6 is substantially vertical. The use of the term "substantially vertical" herein is intended to include an angle no greater than 10° from the vertical. One of the legs of the U-shaped tank is fitted with conduit means 7 or other means to permit introduction of reactive liquor into the bath. The other leg of the bath is equipped with drain means 8 to permit exhausting of liquor from the tank. Conduit means 7 and drain means 8 are located at least 1 meter above the axis of rotation of roll 4 in order that appropriate depth of fluid may be maintained in the bath as will be explained in greater detail hereinafter.

As wool sliver is a relatively delicate product and cannot be subjected to tensile stresses, one of the most convenient means for conveying the sliver into and out of the bath is the use of a pair of relatively open screens with the wool sliver contained between the screens. In this manner, the wool may be conveyed into the bath without subjecting the wool to any tensile stresses, while at the same time leaving the wool open to saturation by the liquid contained within the tank. Idler rolls 10 and 11 and 13 and 14 are provided to permit use of endless belt-like screens to convey the wool sliver. Accordingly, the apparatus shown in FIG. 1 comprises a first screen 9 which most conveniently is in a continuous belt-like form which is successively guided by roll 5, roll 4, roll 6, roll 10 and roll 11. The apparatus also comprises a second similar endless belt-like screen 12 which is successively guided by roll 5, roll 4, roll 6, roll 13 and roll 14. Screens are the most advantageous conveying means as they permit release of the air being expelled from the capillaries of the sliver and also facilitate ingress of reactant liquor as the sliver is conveyed into the bath. With such an apparatus the wool sliver (which is not shown) may be fed in between the screens by any convenient means between rolls 5 and 14. The wool sliver is then conveyed between the screens substantially vertically downwardly into the bath and around roll 4 and then substantially vertically upwardly out of the bath and between rolls 6 and 13.

As shown in FIG. 1 the inlet conduit 7 provided to supply liquor to the tank is located above the drain 8. The inlet conduit 7 and outlet conduit 8 are each fitted with valves (not shown) to control both in-flow and out-flow from the tank. When in operation, the bath will contain a liquid as hereinbefore described shown generally as 15. The level of the upper surface of the liquid 16 in the inlet leg of the bath is above the level 17 of the liquid in the outlet leg of the bath. Thus, in operation there will be a constant flow of liquid from the inlet conduit 7 into the bath downwardly through the inlet or left hand leg as shown in FIG. 1 and upwardly through the outlet or right hand leg and out the outlet 8.

The length of the bath in the direction perpendicular to the cross-section illustrated in FIG. 1 may be any convenient dimension depending on the number of sliver which are intended to be treated at the same time. As stated above, wool sliver may of the order of 1 to 1½ inches in diameter. Accordingly, if the bath is required to treat several wool sliver at once in order to match other production length of the bath is designed to accommodate the required number of sliver. As most plants will require treatment of more than a single wool sliver of time it is suggested that rolls rather than simple pulleys be used to guide the screens. The width of the screens can similarly be chosen to accommodate the number of strands of sliver as desired.

The rate of immersion of the sliver into the bath is controlled by the rate of travel of the screens. An electric motor or other convenient means can be used to drive rolls 5 and 14 or other convenient rolls. It will be appreciated of course that in order to prevent damage to the sliver screens 9 and 12 must travel at the same rate.

As the sliver passes upwardly out of the tank it will pass between the rolls 6 and 13. Rolls 6 and 13 may be conveniently located with their surfaces sufficiently close together to squeeze any excess liquid from the wool sliver. If such a procedure is adopted the excess sliver draining from the capillaries and squeezed from the sliver by the rolls will drip back into the bath. Thus, the liquid at the surface 17 in the upward leg of the bath will be largely spent liquid which is continuously exhausted through outlet 8 to waste. The liquid entering the tank through inlet conduit 7 will be the solution in the desired characteristics of strength pH and temperature as required.

By use of valves in inlet conduit 7 and outlet conduit 8 the fluid level 16 in the left hand leg of FIG. 1 is maintained at least 1 meter above the axis of rotation of submerged roll 4. Thus, as the wool sliver travels substantially vertically downward in this leg it will be submerged to a depth of at least 1 meter while travelling in the substantially vertical direction. In this manner, it is ensured that all capillaries of the sliver are completely evacuated of air and filled with reactive liquor.

The apparatus has been illustrated such that each of the conveying screens is guided by a series of five rolls. It will be obvious to those skilled in the art that any number of rolls may be used without departing from the scope of this invention. It will also be obvious that any means of drive could be used to ensure that the two screens travel at the same rate. The only essential is that the lower submerged roll 4 and guide roll 5 must ensure that the sliver enter the bath and travel downwardly therein to a depth of at least 1 meter in a direction which is within 10° or less of the vertical.

While the apparatus disclosed hereinbefore is useful with any of the known shrinkproofing solutions it will be obvious that such apparatus is particularly advantageous when used with the novel solution disclosed herein. As the novel solution disclosed herein is essentially self-limiting in its reaction there will be no need to convey the sliver to a second bath to stop the reaction as the fluid is squeezed from the sliver by roll 6 and roll 13. The sliver may be simply dried and stored for further processing.

Examples illustrating the above-noted invention are set out hereinafter:

EXAMPLE 1

50 Kilograms of a combed wool sliver—64's quality—with a sliver weight of 2 ounces per 5 yards was fed through the machine in the form of 24 parallel slivers at a rate of 18 centimeters per second. The bath contained hypochlorous acid solutions (available chlorine 0.10%) at 8° C. and the tank was kept filled as liquor was continuously removed from it. The exit sliver was squeezed, rinsed and dried. It showed excellent shrinkproofing to standard wash tests and even treatment throughout the sliver in standard dye test.

EXAMPLE 2

50 Kilograms of a combed wool sliver—60's quality, sliver weight—4½ ounces per 5 yards was fed to the machine as 20 parallel slivers at 18 centimeters per second. The bath contained hypochlorous acid solution (0.12% available chlorine) at 10° C. and was kept filled to offset the liquor continuously removed from it. The final sliver showed excellent and homogenous shrinkproofing throughout.

What I claim is:

1. A process for shrinkproofing wool sliver comprising: immersing said wool sliver in a direction not greater than 10° from vertical into a bath of shrinkproofing solution to a depth of at least 1 meter, at a rate of immersion into said shrinkproofing solution equal to or less than the rate at which said solution displaces air from the capillaries of said sliver, and thereafter removing said sliver from said solution, said solution being an aqueous hypochlorous acid solution.

2. A continuous process according to claim 1, wherein said wool sliver is continuously immersed into and withdrawn from said solution, and aqueous hypochlorous acid solution is continuously added to replace any liquid conveyed away as said sliver is removed from said solution.

3. The process of claim 2, wherein said sliver is immersed in said solution at a rate of immersion of about 7 centimeters per second to about 25 centimeters per second.

4. The process of claim 3, wherein after said sliver is removed from said solution it is squeezed, rinsed free from said solution and dried.

5. The process of claim 2, wherein said solution is made by passing chlorine gas into water.

6. The process of claim 5, wherein said solution has a pH from about 2.0 to about 2.6.

7. The process of claim 6, wherein said solution is maintained at a temperature from about 6° C. to about 20° C.

* * * * *